United States Patent [19]

Yates

[11] 4,066,258

[45] Jan. 3, 1978

[54] SEAT FOR A CHILD'S SWING

[75] Inventor: Victor Horace Yates, Shelley, near Huddersfield, England

[73] Assignee: The Sutcliffe Engineering Holdings Limited, Ossett, England

[21] Appl. No.: 660,433

[22] Filed: Feb. 23, 1976

[30] Foreign Application Priority Data

Mar. 6, 1975 United Kingdom ..... 9361/75

[51] Int. Cl.[2] ..... A63G 9/00

[52] U.S. Cl. ..... 272/85; 297/452

[58] Field of Search ..... 272/85, 86, 87, 88, 272/89, 90, 91, 92; 248/339; 267/142, 143; 297/452

[56] References Cited

U.S. PATENT DOCUMENTS

| | | | |
|---|---|---|---|
| 1,975,262 | 10/1934 | Evans et al. | 248/339 |
| 2,225,737 | 12/1940 | De Vaney | 272/85 |
| 3,261,607 | 7/1966 | Horowitz et al. | 272/85 |
| 3,712,614 | 1/1973 | Sherman et al. | 272/85 |

FOREIGN PATENT DOCUMENTS

| | | |
|---|---|---|
| 2,121,857 | 5/1974 | France. |
| 808,758 | 7/1951 | Germany. |
| 847,131 | 9/1960 | United Kingdom. |
| 936,896 | 9/1963 | United Kingdom. |
| 1,032,766 | 6/1966 | United Kingdom. |
| 1,216,453 | 12/1970 | United Kingdom. |
| 1,299,617 | 12/1972 | United Kingdom. |
| 1,304,373 | 1/1973 | United Kingdom. |
| 1,303,852 | 1/1973 | United Kingdom. |

OTHER PUBLICATIONS

"Rubber in Engineering Practice", 1964, Davey and Payne; published by Maclaren & Sons (London), Palmerton Publishing Co. (New York), pp. 297–298, 320–309, 314–319, 349–350, 132–139, 238–245, 252–253.

*Primary Examiner*—William H. Grieb
*Attorney, Agent, or Firm*—Brisebois & Kruger

[57] ABSTRACT

A seat for a childs swing is of composite structure having a first member, which is sufficiently rigid to bear the weight of a child, and a second member made of a compressible polymeric material. The first member is substantially laminar and the second member covers at least part of the peripheral edge of the first member. The force-deflection characteristic of the second member is such that, on any impact with an object, the second member initially deforms to conform with the shape of the impacted object and then deforms further to absorb the main energy of the impact.

23 Claims, 7 Drawing Figures

SEAT FOR A CHILD'S SWING

This invention relates to a seat for a child's swing.

The seat of a child's swing is traditionally made of wood. The main disadvantage of such seats is that they are hard. Thus, as a child's swing can travel at speeds in excess of 30 m.p.h. and even unmanned can impact with a force of many tons, if a child is hit by such a seat, he or she will probably be hurt and may even fracture a bone.

To reduce the severity of accidents, the recent practice has been to replace the wooden seat with a moulded plastics seat, which is considerably lighter than a comparable wooden seat and so less likely to cause severe accidents, or an old car tyre which tends to give during collisions. The main disadvantages of the moulded plastics seat are its hardness, which still results in cuts and bruises in collisions with children, and its susceptibility to vandalism. The disadvantages of swing seats composed of old car tyres are that they are not sufficiently rigid to provide a firm platform on which a child can either sit or stand during swinging, that they require painting to prevent marking of children's clothing, and that they too are prone to vandalism. Moreover, a car tyre tends to give appreciably only if struck at the centre of its tread pattern. Thus, if a child is hit by the sidewall or the buttress of the tread of a swinging tyre, there is still a considerable risk of severe injury to the child.

In another attempt to reduce the severity of accidents, strips of foamed plastics material have been stuck round the edges of wooden and metal seats. Unfortunately, this has not been successful in reducing significantly the impact load of such a swing seat. Moreover, the strips tend to peel off and are very susceptible to vandalism.

The present invention provides a seat for a child's swing, the seat being of composite structure comprising a first member, which is sufficiently rigid to bear the weight of a child, and a second member made of a compressible polymeric material, the first member being of substantially laminar form and the second member covering at least part of the peripheral edge of the first member, wherein the force-deflection characteristic of the second member is such that, on impact with an object, the second member initially deforms to conform with the shape of the impacted object and then deforms further to absorb the main energy of the impact.

Preferably, the second member covers the entire peripheral edge of the first member. Such a seat is, therefore, strong enough to support a child but is cushioned at the edges to minimise the possible injury to a child hit by the seat.

Advantageously, a plurality of blind apertures are provided in the second member, the apertures extending along, and adjacent to, the periphery of the first member and the axes of the apertures being substantially perpendicular to the first member. Preferably, each of the apertures is of circular cross-section.

The first member and the swing seat may be generally of rectangular configuration, the apertures extending in rows along the sides of the seat. Preferably, the apertures extending along any given side of the seat are all of the same diameter.

Advantageously, the apertures extending along both of a first pair of opposite sides of the seat have the same diameter and the apertures extending along both of the second pair of opposite sides of the seat have the same diameter, the apertures extending along the second pair of sides having a greater diameter than the apertures extending along the first pair of sides. Preferably, the parts of the second member forming the first pair of sides are each provided with a respective further row of blind apertures parallel to the corresponding first-mentioned row of apertures. In this case, the apertures in said further rows may be of circular cross-section and have the said diameter, the diameters of the apertures in said further rows being less than the diameters of the apertures in the corresponding first rows of apertures, and their centres being off-set with respect to the centres of the apertures in the corresponding first rows of apertures.

Preferably, the apertures in any row are equispaced.

The distance between the centres of each pair of adjacent apertures in any row is, preferably, not greater than 1.33 times the diameter of the apertures in that row. Also, the distance between the centre of each aperture in any given row and the adjacent edge of the swing seat is, preferably, not greater than 0.75 times the diameter of the apertures in that row.

This arrangement of apertures leaves a plurality of relatively thin columns of polymeric material extending right round the periphery of the seat, each column being at right-angles to the adjacent edge of the seat. These columns act in a very similar way to Euler buckling struts and so permit the second member to absorb quite large impact loads. Thus, the first pair of opposite sides (the front and rear sides of the seat) each have two rows of apertures. As the seat hits an object, such as the head of a child, the initial deformation permits the soft outer "skin" of the compressible material to deform to the contours of the impacted area of the object. This initial deformation includes a deformation of the soft outer "skin" and a buckling of thin columns left between the apertures of the first row of apertures. This is followed by a buckling of the larger columns left between the smaller apertures of the further row, which absorbs the main energy of the impact.

Advantageously, the second member is made of a material having a hardness lying within the range of from 40 to 50 I.R.H.D., and preferably the second member is based on a mixture of ethylene-propylene terpolymer and polychloroprene, the polychloroprene being present to at least 10% of the total polymer content. The unit I.R.H.D. is the standard unit for measuring the hardness of rubber and rubber-like materials, the letters standing for "International Rubber Hardness Degrees."

Preferably, the first member is made of a sheet of mild steel 1/16 of an inch thick. This helps to keep down the weight of the swing seat which is very important as the proposed British Standards Institute maximum allowed weight for such a seat is 3 kg. This reduction of mass is also important as it results in lower kinetic energies during use which in turn means lower impact energies. In order to improve the rigidity of such a thin sheet, it may be formed with strengthening means constituted by an integral flange formed along, and substantially at right-angles to, each edge of the first member. Even these flanges may not prevent distortion of the seat by vandals and so it is preferable for each flange formed along one of the longer sides of the first members to be provided with a reinforcing strip of ⅛ inch thick mild steel spot welded thereto. A further form of increasing the rigidity of the steel sheet is to provide it with a number of corrugations.

A thin layer of the material from which the second member is made may cover both faces of the laminar first member. Preferably, the layer of material covering that side of the first member which, in use, is uppermost, is provided with a non-slip finish. This tends to prevent a child slipping off the swing seat.

Advantageously, the second member is compression moulded to the first member. Not only is this a cheap and easy manufacturing process, but also with the preferred materials helps to provide a firm bond between the first and second members.

Two forms of swing seat constructed in accordance with the invention will now be described, by way of example, with reference to the accompanying drawings, in which.

Figure 1:
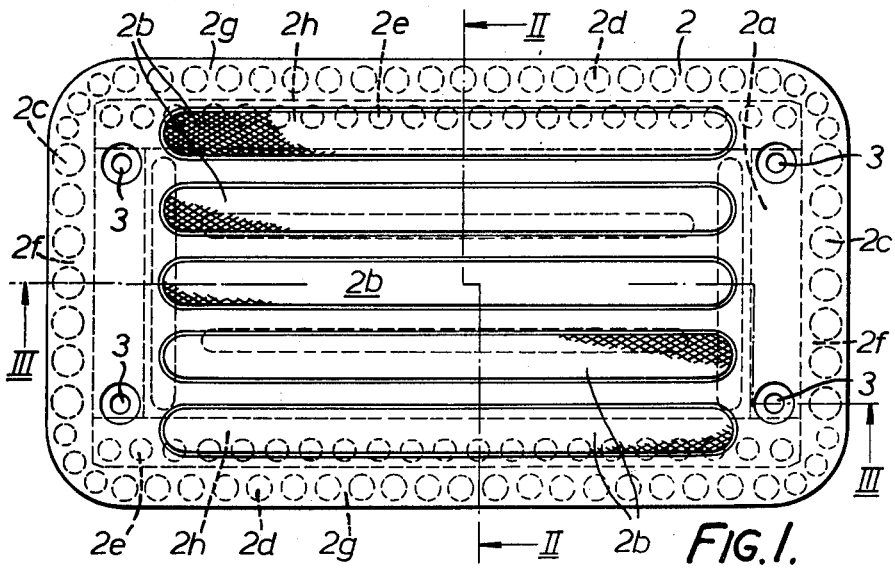
FIG. 1 is a plan view of the first form of seat.
Figure 2:
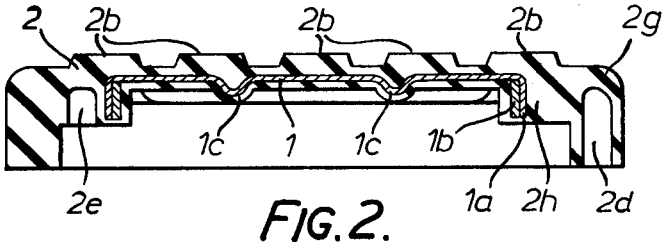
FIG. 2 is a cross-section taken on the line II—II of FIG. 1.
Figure 3:
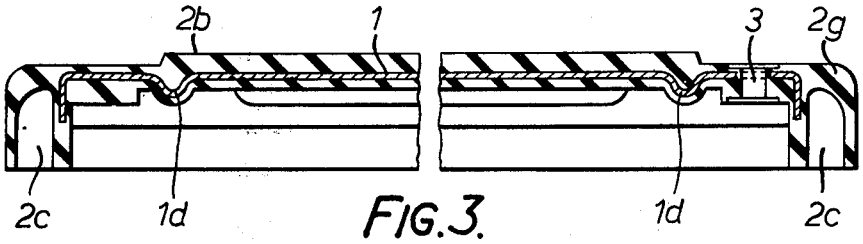
FIG. 3 is a cross-section taken on the line III—III of FIG. 1.
Figure 4:
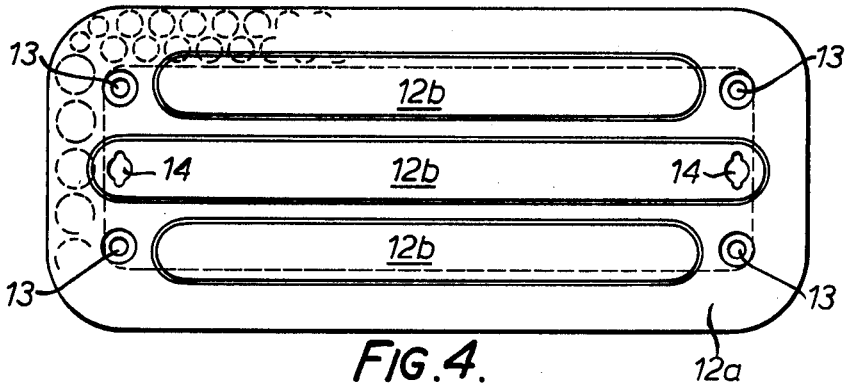
FIG. 4 is a plan view of the second form of seat.
Figure 5:
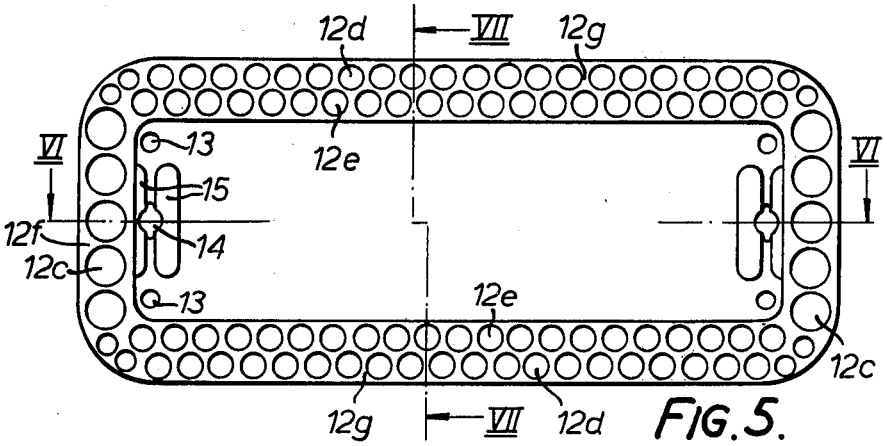
FIG. 5 is an underneath view of the seat of FIG. 4.
Figure 7:
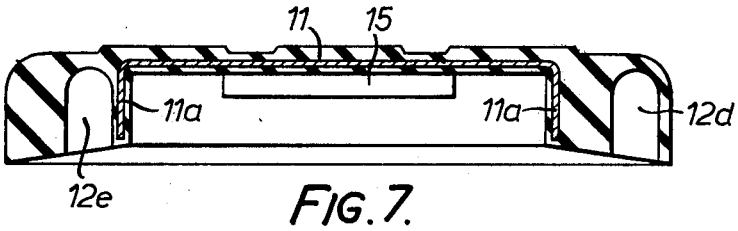
FIG. 7 is a cross-section taken on the line VII—VII of FIG. 5.
Figure 6:
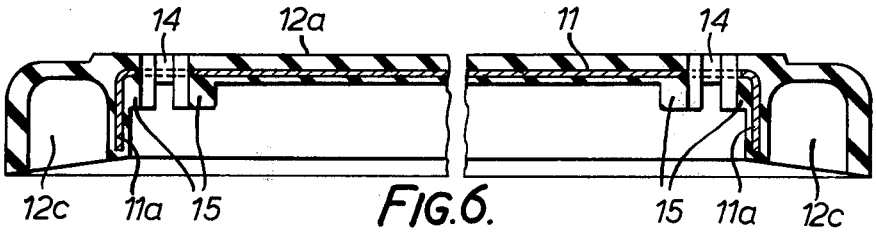
FIG. 6 is a cross-section taken on the line VI—VI of FIG. 5.

Referring to the drawings, FIGS. 1 to 3 show a seat for a child's swing which comprises a generally rectangular mild steel member 1 and a cushioning member 2 made out of a compressible polymeric material. The seat is 17½ inches long, 9½ inches wide and has rounded corners. The steel member 1 is made from a sheet 1/16 inch thick and is provided with an integral flange 1*a* which depends at right-angles from its peripheral edge. This flange 1*a* increases the rigidity of the member 1 so that it can take a weight of 125 kg. Those parts of the flange 1*a* depending from the longer sides of the sheet 1 are provided with a reinforcing strip 1*b* of ⅛ inch thick mild steel spot welded thereto. A pair of longitudinally extending corrugations 1*c* and a pair of transversely extending corrugations 1*d* are provided to increase further the rigidity of the member 1.

The cushioning member 2 is arranged to cover the entire surface of the steel member 1. The upper part 2*a* of the cushioning member 2 is provided with five upstanding ribs 2*b*, each of which has a knurled upper surface. The ribs 2*b* and their knurled surfaces help to prevent a child from slipping off the seat when the swing is being used.

The cushioning member 2 is made of a polymeric material based on a mixture of an ethylene-propylene terpolymer and polychloroprene. One suitable example is constituted by 57.91% ethylene-propylene terpolymer, 8.58% polychloroprene, 3.43% zinc oxide, 0.43% stearic acid, 1.58% accelerators, 0.64% sulphur, 0.86% sun-checking wax, 3.04% dyestuff, 6.40% silica, 6.40% aluminium silicate, 2.15% titanium dioxide and 8.58% paraffinic oil.

The cushioning member 2 is compression moulded to the steel member 1. In order to bond the two members together, the steel member 1 is provided, prior to the moulding process, with several coats of a bonding agent such as Chemlok® or Thixon®. In order to ensure that the cushioning member 2 is firmly bonded to the steel member 1, the polychloroprene content of the polymeric material should be at least 10% of the total polymer content of the material. That part of the cushioning member 2 surrounding the flange 1*a* of the steel member 1 is provided with three sets of blind apertures 2*c*, 2*d* and 2*e* these holes being formed during the compression moulding of the cushioning member. The apertures 2*c* are each of a diameter of ¾ of an inch and are provided in two rows, one adjacent each of the shorter edges of the seat. The apertures 2*d* are each of a diameter of 9/16 of an inch and are provided in two rows, one adjacent each of the longer edges of the seat. The apertures 2*e* are each of a diameter of ½ of an inch and are provided in two rows, one situated between each of the rows of apertures 2*d* and the corresponding flange 1*a*. The apertures in each of the rows are equispaced, the centres of adjacent apertures 2*c* being ⅞ of an inch apart, the centres of adjacent apertures 2*d* being ⅝ of an inch apart and the centres of adjacent apertures 2*e* being ⅝ of an inch apart. The apertures of rows 2*e* are staggered with respect to the apertures of rows 2*d*. Each of the centres of the apertures 2*c* is spaced from the adjacent edge of the seat by a distance of ⅛ of an inch and each of the centres of the apertures 2*d* is spaced from the adjacent edge of the seat by a distance of 11/32 of an inch. The apertures 2*c* formed in a portion 2*f* of the cushioning member 2 which is 13/16 of an inch thick and which extends well below the bottom surface of the steel sheet 1. Similarly, the apertures 2*d* are formed in a portion 2*g* of the cushioning member 2 which is 11/16 of an inch thick and which extends as far below the bottom surface of the steel sheet 1 as does the portion 2*f*. The apertures 2*e* are formed in a portion 2*h* of the cushioning member 2 which is ⅞ of an inch thick but which extends below the bottom surface of the steel sheet 1 only about half the distance to which the portions 2*f* and 2*g* extend.

The spacing and size of each set of apertures 2*c*, 2*d* and 2*e* in relation to the thickness of the portions 2*f*, 2*g* and 2*h* results in an arrangement wherein each set of apertures leaves a plurality of relatively thin columns of polymeric material extending right round the periphery of the seat, each column being at right-angles to the adjacent edge of the seat. These columns act as Euler buckling struts so that the cushioning member 2 can absorb quite large impact loads. Strictly speaking, Euler buckling strut theory only applies to columns of uniform cross-section, but it is clear that the columns left between these circular apertures act in a very similar fashion. An arrangement of elliptical apertures (major axes at right-angles to adjacent seat periphery) would give a better agreement with theory, but this would cause difficulties in the moulding of the cushioning member.

The front and rear edges of the seat are provided with two rows of apertures 2*d* and 2*e*. As the swinging seat hits an object, such as the head of a child, the initial deformation is taken by the outer "skin" and on the thin columns left between the apertures 2*d*. This permits the soft outer "skin" of the cushioning member 2 to deform to the contours of the impacted area of the object. This is followed by a buckling of the larger columns left between the apertures 2*e* which absorbs the main energy of the impact. The extra row of blind apertures 2*e* provided at the front and rear of the seat ensure increased compressibility at those places most likely to hit a child.

The rows of apertures 2*c* at the sides of the seat act in a similar way to cushion impacts in these regions. Here, although there is only one row of apertures 2*c*, the cushioning effect is almost as good as at the front and rear of the seat. The initial deformation is taken up by the buckling of the columns left between the apertures 2c and the main energy of the impact is taken up by the deformation of the portion 2f of the cushioning member 2.

The blind apertures 2c, 2d and 2e also help to reduce the weight of the seat so as to conform with B.S.I. requirements. Indeed the weight of this seat is approximately 2.5 kg which is well within the B.S.I. limit of 3 kg. Consequently, if this seat hits a child it is less likely to injure that child than a conventional swing seat.

Adjacent each lateral edge of the seat are provided a pair of holes 3 for receiving the bolts (not shown) by means of which the seat is fastened to the chains of the swing.

The seat described above is intended primarily for use in parks, children's playgrounds and other public places. Thus, it needs to be resistant to attacks by vandals and so needs strengthening features such as the corrugations 1c and 1d and the reinforcing strips 1b. The embodiment of FIGS. 4 to 7 is for domestic use, that is to say for use in the gardens of domestic houses or in other private surroundings. This embodiment is much less susceptible to vandalism and so does not incorporate these additional strengthening features. In most other respects, this domestic seat is identical with the seat of FIGS. 1 to 3. Thus, this seat comprises a generally rectangular mild steel member 11 and a cushioning member 12. The seat is 17 inches long, 6¼ inches wide and has rounded corners. The steel member 1 is made from a sheet 1/16 of an inch thick and is provided with an integral flange 11a which depends from its peripheral edge. This flange 11a increases the rigidity of the steel member 11 so that it can resist the forces exerted by a load of up to 125 kg.

The cushioning member 12, which is made of the same polymeric material as the cushioning member 2 of the seat of FIGS. 1 to 3, is arranged to cover the entire surface of the steel member 11. The upper part 12a of the cushioning member 12 is provided with three upstanding ribs 12b and the whole of the upper surface 12a and the ribs 12b are provided with a grained finish. The ribs 12b and the grained finish help to prevent a child from slipping off the seat when the swing is being used.

The cushioning member 12 is compression moulded to the steel member 11, the grained finish on the surface 12a and the ribs 12b being formed during the moulding. That part of the cushioning member 12 surrounding the flange 11a of the steel member 11 is provided with three sets of blind apertures 12c, 12d and 12e. The apertures 12c are each of a diameter of ¾ of an inch and their centres are ⅞ of an inch apart. They are formed in two portions 12f of the cushioning member 12 which are 1 inch thick. The centres of the apertures 12c lie ½ of an inch from the adjacent edge of the seat. The apertures 12d and 12e are all of a diameter of 7/16 of an inch and their centres are 9/16 of an inch apart. The apertures 12d and 12e are formed in portions 12g of the cushioning member 12 which are 1¼ of an inch wide, the apertures 12e being staggered with respect to the apertures 12d. The centres of the apertures 12d lie 11/32 of an inch from the adjacent side of the seat and the centres of the apertures 12e lie 13/16 of an inch from the adjacent side of the seat. The apertures 12c, 12d and 12e thus provide a plurality of columns which, in a similar manner to that described above with respect to the seat of FIGS. 1 to 3, act as Euler buckling struts and so minimise the injury risk to a child hit by the seat.

Adjacent each lateral edge of the seat are provided a pair of holes 13 for receiving the support bracket (not shown) by means of which the seat is fastened to the chains of the swing. A further hole 14 is provided between each pair of holes 13. These holes 14 are used in conjunction with pairs of ribs 15, provided on the underneath of the seat, for receiving an alternative form of support bracket (not shown).

It will be apparent that a number of modifications could be made to the swing seat described above. Thus, the cushioning member 2 or 12 could be made of other materials than that specified, for example it could be made from rubber or foamed polyvinyl chloride. It would also be possible, particularly for the domestic seat, to use reinforced fibre glass instead of steel for the member 11. Furthermore, the cushioning member 2 or 12 need not be compression moulded to the member 1 or 11, it being possible to use an injection moulding or a transfer moulding process. It is also possible to bond these members together using only an adhesive. Also it is possible to bond by mechanical means, in which case the member 1 or 11 is provided with a plurality of apertures through which the two parts of the cushioning member can be bonded. A plurality of such apertures may, in any case, be provided in the steel member 1 or 11 for further reducing the weight of the finished seat.

It will be apparent that each of the swing seats described above is much safer than any known type of swing seat. Thus, tests have shown that the impact forces of the various types of prior art swing seat are:

a. for a moulded polypropylene seat — 4.5 times greater than the swing seats of FIGS. 1 to 3;

b. for a cross-ply tyre on its sidewall — 6.4 times greater than the swing seats of FIGS. 1 to 3;

c. for a standard hardwood seat — 25.0 times greater than the swing seats of FIGS. 1 to 3.

No tests have been carried out on the swing seat of FIGS. 4 to 7 but as this seat is lighter than that of FIGS. 1 to 3, the impact force should be even less than that of FIGS. 1 to 3. Moreover, the swing seats described above are resistant to both vandals and the effects of the weather.

Although swing seats have been referred to throughout this specification as for children, it will be apparent that, as the swing seat described above is capable of resisting the force exerted by a swinging load of up to 125 kg, it is also suitable for use by adults.

What I claim is:

1. A seat for a child's swing, the seat being of composite structure comprising a generally rectangular substantially laminar first member, which is sufficiently rigid to bear the weight of a child, and a second member made of a compressible polymeric material covering the entire peripheral edge of the first member, there being:

apertures all of the same diameter extending along both of a first pair of opposite sides of the second member, apertures all of the same diameter, greater than the diameter of the apertures in said first pair of opposite sides, extending along a second pair of sides of the second member, a respective row of further circular cross-section blind apertures all of the same diameter provided in each of the parts of the second member forming the first pair of sides, said further row of blind apertures being parallel to the corresponding first-mentioned row of apertures, the diameters of said further apertures being less than the diameters of the apertures in the corresponding first rows of apertures, and their centres being off-set with respect to the centres of the apertures in the corresponding first rows of apertures, wherein the force-deflection characteristic of the second member is such that, on impact with an object, the second member initially deforms to conform with the shape of the impacted object and then deforms further to absorb the main energy of the impact.

2. A swing seat as claimed in claim 1, wherein the apertures in any row are equispaced.

3. A swing seat as claimed in claim 2, wherein the distance between the centres of each pair of adjacent apertures in any row is not greater than 1.33 times the diameter of the apertures in that row.

4. A swing seat as claimed in claim 1, wherein the distance between the centre of each aperture in any given row and the adjacent edge of the swing seat is not greater than 0.75 times the diameter of the apertures in that row.

5. A swing seat as claimed in claim 1, wherein the second member is made of a material having a hardness lying within the range of from 40 to 50 I.R.H.D.

6. A swing seat as claimed in claim 1, wherein the second member is based on a mixture of an ethylene-propylene terpolymer and polychloroprene, the polychloroprene being present to at least 10% of the total polymer content.

7. A swing seat as claimed in claim 1, wherein the first member is made of a sheet of mild steel.

8. A swing seat as claimed in claim 7, wherein the sheet of steel is 1/16 of an inch thick.

9. A swing seat as claimed in claim 7, wherein an integral flange is formed along, and substantially at right-angles to, each edge of first member.

10. A swing seat as claimed in claim 9, wherein each flange formed along one of the longer sides of the first member is provided with a reinforcing strip of ⅛ inch thick mild steel spot welded thereto.

11. A swing seat as claimed in claim 7, wherein the steel sheet is provided with a number of corrugations.

12. A swing seat as claimed in claim 1, wherein a thin layer of the material from which the second member is made covers both faces of the laminar first member.

13. A swing seat as claimed in claim 12, wherein the layer of material covering that side of the first member which, in use, is uppermost, is provided with a non-slip finish.

14. A swing seat as claimed in claim 1, wherein the second member is compression moulded to the first member.

15. A seat for suspension in a horizontal position as, for example, by chains to form a swing, said seat comprising:

a core member of generally laminar form having sufficient rigidity to bear the weight of a user, compressible polymeric material covering said core member and having substantial depth and thickness around the periphery of said core member, first wall means formed by a part of said compressible polymeric material and located adjacent the periphery of said core member, second wall means formed by another part of said compressible polymeric material and defining a pliant peripheral skin at the periphery of said seat, buckling struts of said material interconnecting said first and second wall means and formed by walls defining a multiplicity of apertures in said compressible polymeric material, said apertures having selected sizes and spacings so that said struts act as buckling struts and said first and second wall means having selected thicknesses so that said wall means and buckling struts co-operate to provide a deflection characteristic such that on impact of the periphery of said seat with an object there is an initial deformation with little absorption of energy in which the shape of the impacted object is taken up by the pliant peripheral skin defined by said second wall means and a subsequent deformation in which substantially all of the impact energy is absorbed, suspension means associated with said core member to enable said seat to be suspended in a horizontal position, wherein said core member is oblong and has first and second major sides and first and second minor sides, wherein said first wall means, at least along said major sides, has a first selected depth and is connected to buckling struts of said first selected depth, and wherein said second wall means, at least along said major sides, has a second selected depth and is connected to buckling struts of said second selected depth, the buckling struts of said first selected depth being connected to the buckling struts of said second selected depth at a location intermediate said first and second wall means, and said second selected depth being substantially greater than said first selected depth.

16. A swing seat as claimed in claim 15, wherein said core member has flanges, there being a flange at least along each of said major sides, of selected depth approximately equal to said first selected depth, said flanges being contiguous with said first wall means.

17. A swing seat as claimed in claim 15, wherein axes of the buckling struts of said first selected depth and of the buckling struts of said second selected depth are normal to the periphery of said core member and the axes of the buckling struts of said first selected depth are offset from the axes of the buckling struts of said second selected depth.

18. A seat for suspension in a horizontal position as, for example, by chains to form a swing, said seat comprising:

an oblong member of generally laminar form having sufficient rigidity to bear the weight of a user, said oblong member having first and second major sides and first and second minor sides, compressible polymeric material covering said oblong member and having substantial depth and thickness around the periphery of said oblong member, first wall portions formed of said polymeric material adjacent the periphery of said oblong member, second wall portions formed of said polymeric material defining a pliant skin at the periphery of said seat, struts of said material interconnecting said first and second wall portions and formed by walls defining a multiplicity of blind apertures of circular cross-section in said material, said apertures having selected sizes and spacings so that said struts act as buckling struts and there being at least two parallel rows of apertures along each of said major sides, said struts and wall portions providing a deflection characteristic such that on impact of the periphery of said seat with an object there is an initial deformation with little absorption of energy in which the shape of the impacted object is taken up by said periphery and a subsequent deformation in which substantially all of the impact energy is absorbed, and first and second means provided adjacent said minor sides of said oblong member to enable said seat to be suspended in a horizontal position.

19. A swing seat as claimed in claim 18, wherein there is one row of apertures running along each minor side of said seat.

20. A swing seat as claimed in claim 18, wherein the distance between the centres of each pair of adjacent apertures is not greater than 1.33 times the diameter of said apertures.

21. A swing seat as claimed in claim 18, wherein the distance between the centre of each aperture and the adjacent edge of the seat is not greater than 0.75 times the diameter of said aperture.

22. A swing seat as claimed in claim 18 wherein said oblong member has integral flange portions depending from said major sides and includes at least one corrugation running parallel to said major sides, each flange portion being contiguous with an associated one of said first wall portions.

23. A swing seat as claimed in claim 18, wherein said oblong member is of sheet steel about 1/16 inch thick having at least one corrugation therein, said compressible polymeric material is a rubber material having a hardness lying within the range of from 40 to 50 I.R.H.D., said apertures extend downwardly and open only beneath said seat, said first means to enable said member to be suspended in a horizontal position comprises portions of said seat defining first and second spaced holes passing through said oblong member, and said second means to enable said member to be suspended in a horizontal position comprises portions of said seat defining third and fourth spaced holes passing through said oblong member.

* * * * *